US006168050B1

(12) United States Patent
Battegazzore

(10) Patent No.: US 6,168,050 B1
(45) Date of Patent: Jan. 2, 2001

(54) HAND-OPERATED PUMP WITH A TRIGGER, FOR DISPENSING LIQUIDS

(75) Inventor: Piero Battegazzore, Alessandria (IT)

(73) Assignee: Guala Dispensing S.p.A., Spinetta Marengo (IT)

( * ) Notice: Under 35 U.S.C. 154(b), the term of this patent shall be extended for 0 days.

(21) Appl. No.: 09/238,582

(22) Filed: Jan. 28, 1999

(30) Foreign Application Priority Data

May 21, 1998 (EP) ..... 09930237.8

(51) Int. Cl.[7] ..... B65D 37/00

(52) U.S. Cl. ..... 222/207; 222/341; 222/212; 222/372; 222/380; 222/383.1; 222/450

(58) Field of Search ..... 222/207, 212, 222/213, 372, 380, 383.1, 384, 470, 472, 341, 481.5, 450

(56) References Cited

U.S. PATENT DOCUMENTS 3,749,290 * 7/1973 Micallef ..... 222/207
3,973,700 * 8/1976 Schmidt et al. ..... 222/207
4,101,057 * 7/1978 LoMaglio ..... 222/207
4,138,038 2/1979 Grogan ..... 222/207
4,155,487 * 5/1979 Blake ..... 222/207
4,204,614 * 5/1980 Reeve ..... 222/207
5,553,752 * 9/1996 Foster et al. ..... 222/383.1

* cited by examiner

*Primary Examiner*—Kevin Shaver
*Assistant Examiner*—David Deal
(74) *Attorney, Agent, or Firm*—Nixon & Vanderhye P.C.

(57) ABSTRACT

A pump for dispensing liquids includes a hollow cylindrical support body having an annular channel formed at a first axial end of the body and open towards the internal cavity of the body. A pumping member in the form of a resiliently-flexible, cup-shaped diaphragm has its cavity facing the annular channel. A lever is pivoted about a pin carried by the hollow cylindrical body and includes a first end that engages the cup-shaped diaphragm of the pumping member for collapsing the diaphragm when it is desired to dispense liquid. A tubular element extends through the cup-shaped diaphragm of the pumping member and guides the axial movement of the pumping member.

11 Claims, 7 Drawing Sheets

HAND-OPERATED PUMP WITH A TRIGGER, FOR DISPENSING LIQUIDS

FIELD OF THE INVENTION

The present invention relates to a pump for dispensing liquids. The pump includes a hollow, cylindrical support body having an annular channel formed at a first axial end of the body and open towards the internal cavity of the body. A delivery duct is carried by the hollow cylindrical body and projects radially therefrom, the delivery duct being in communication with the annular channel by means of an orifice. Engagement structure is disposed at the other end of the hollow cylindrical body for the connection of the pump to a container of liquid to be dispensed, and a pumping member in the form of a resiliently-flexible, cup-shaped diaphragm which has its cavity facing the channel and a convex surface facing the structure for connection to the container of liquid is housed in the hollow cylindrical body. A flange is fixed to the diaphragm of the pumping member, projecting radially outwardly relative to the cavity and connected peripherally to the internal wall of the hollow cylindrical body in order to anchor the pumping member to the cylindrical body. A lever is mounted for pivoting about a pin carried by the hollow cylindrical body, the lever having a first end disposed inside the cavity of the hollow cylindrical body in contact with the convex surface of the cup-shaped diaphragm of the pumping member and a second end formed as a trigger, disposed outside the hollow cylindrical body, for the manual operation of the pumping member in opposition to the resilient force due to the deformation of the cup-shaped diaphragm of the pumping member.

BACKGROUND OF THE INVENTION

Pumps for dispensing liquids of the type specified above are known in the art.

Examples of these pumps are described in patents U.S. Pat. Nos. 4,138,038 and 3,995,774.

The basic problem encountered in known liquid-dispensing pump structures of the type specified above relates to the tortuous nature of the passageways for the liquid through the pumping member, which cause considerable pressure losses and thus appreciably reduce the efficiency of the pumps which, in any case, is limited owing to the very nature of small hand-operated pumps.

Another problem which is encountered in known pump structures relates to the poor functional capacity of the valve members in the pipe for drawing the liquid from the container and for supplying it to the delivery duct.

In known structures, these valve functions are performed by respective portions of a single annular lip of the cup-shaped diaphragm of the pumping member, these portions having to be deformed in opposite directions during each stage of the operation of the pump in order to draw liquid from the container and to supply liquid to the delivery pipe, respectively, whilst belonging to the same structural element of the diaphragm.

This leads to warping of the portions of the lip which are intended to operate as valve elements with consequent loss of sealing capacity and, in the final analysis, with a loss of efficiency of the pump.

The object of the present invention is therefore to provide a hand-operated pump structure for dispensing liquids having improved valve devices, the efficiency of which is maintained in the long term and in which tortuous paths are not created for the passage of the liquid to be dispensed, with the overall result of better pumping efficiency.

A further object of the present invention is to provide a very compact pump structure with a limited number of components all of which can be produced by molding.

The above-mentioned objects are achieved by a pump of the type mentioned above.

BRIEF DESCRIPTION OF THE DRAWINGS

The invention will now be described in greater detail with reference to an embodiment illustrated in the appended drawings, in which.

DETAILED DESCRIPTION OF THE INVENTION

Figure 1:
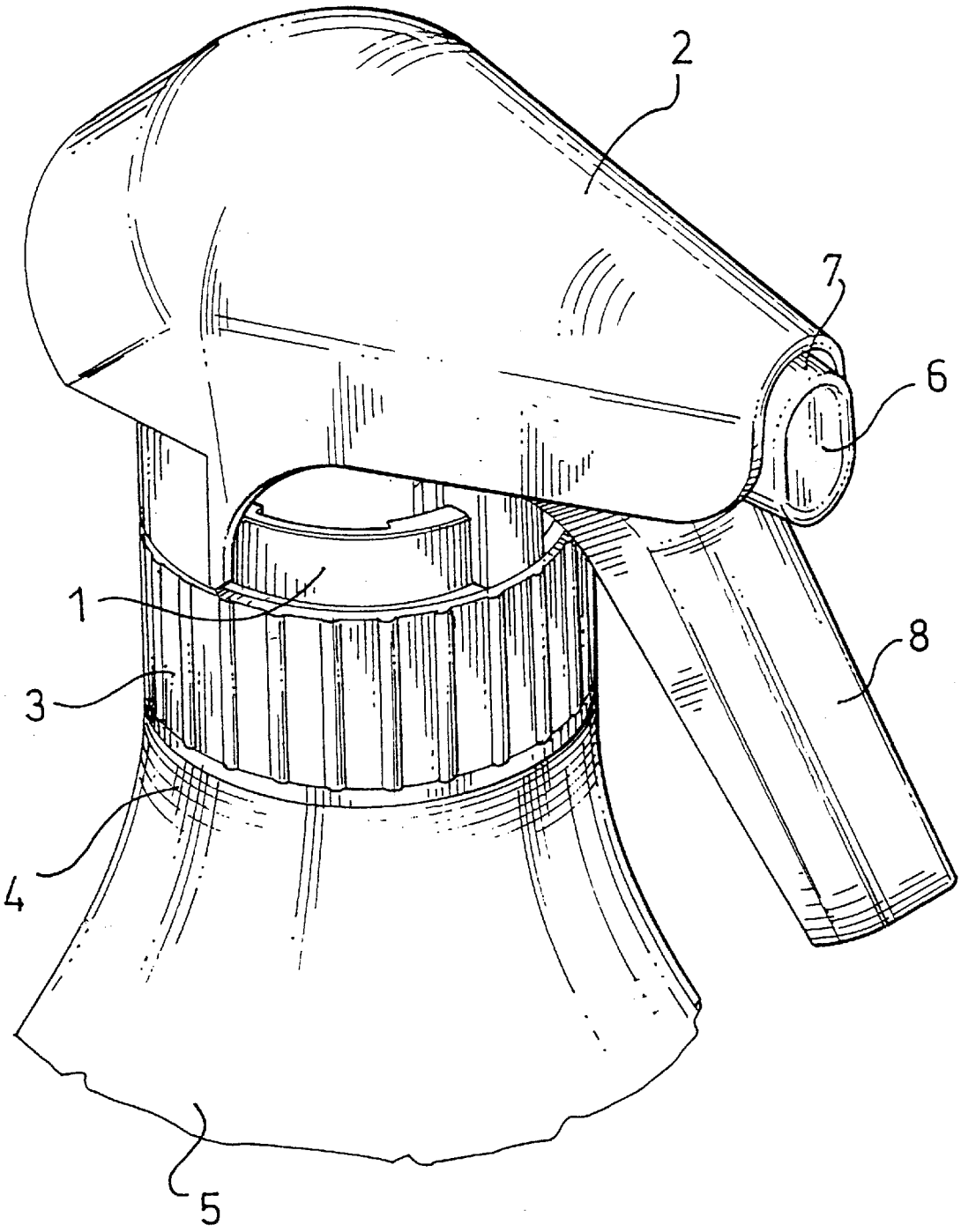
FIG. 1 is a perspective view of the pump with its cap.

With reference to the drawings, the hollow cylindrical body of the pump is generally indicated 1, the boat-shaped cap of the pump is indicated 2, and a threaded ring for screwing the pump onto the neck 4 of a container 5 of liquid to be dispensed through the end 6 of a delivery duct 7 is indicated 3.

The trigger-like end of a lever 9 mounted for pivoting on a pin 10 carried by an axial rib 1*a* of the cylindrical body 1 is indicated 8.

Figure 8:
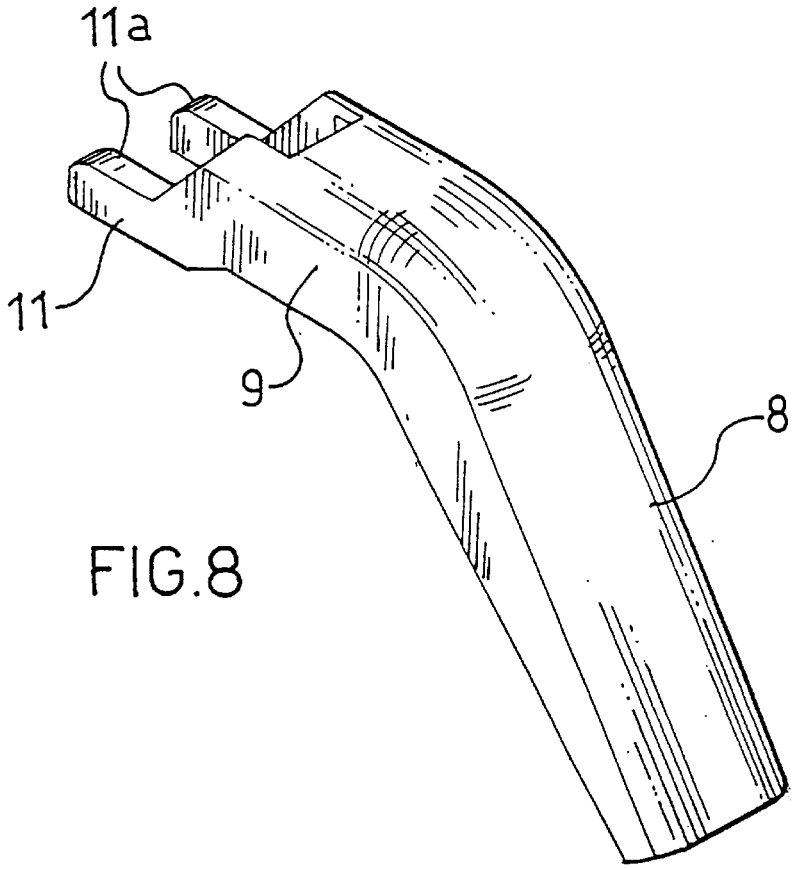
FIG. 8 is a perspective view of the operating lever of the pump.
Figure 7:
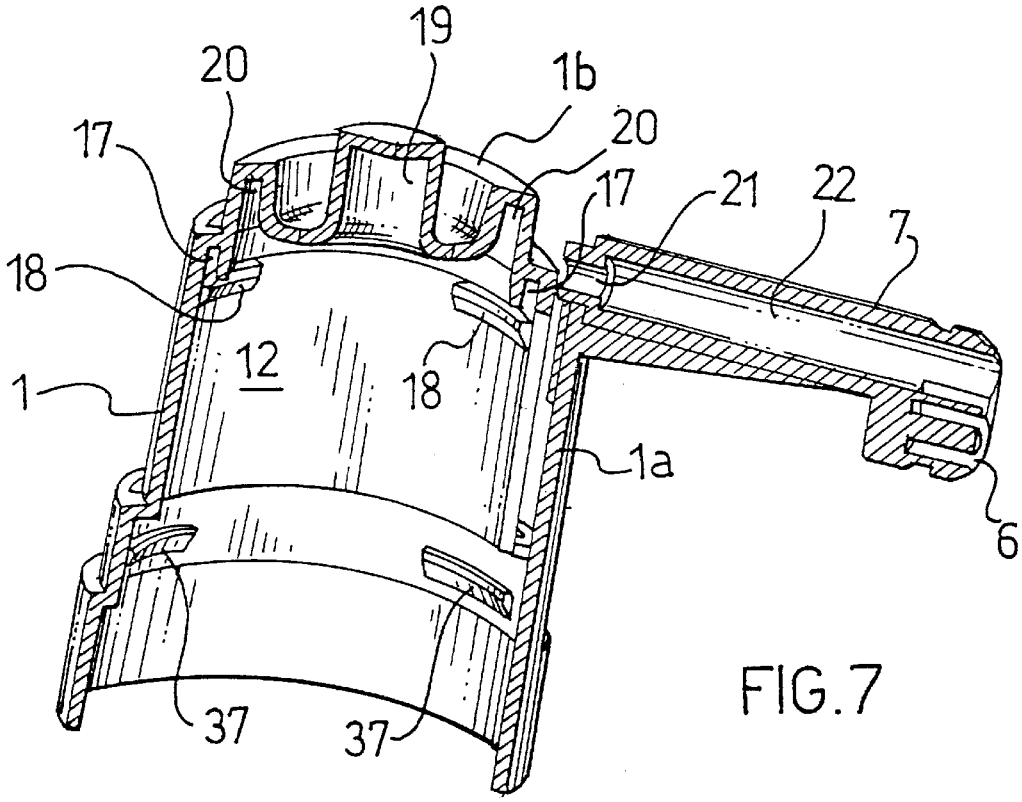
FIG. 7 is a section taken on the line VII—VII of FIG. 6.
Figure 6:
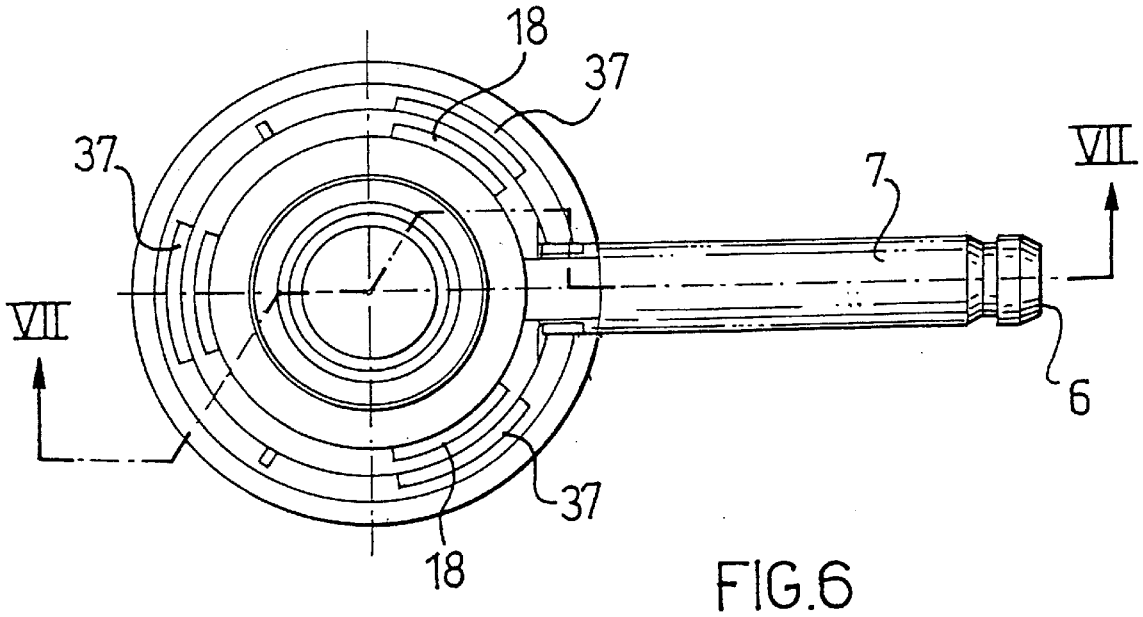
FIG. 6 is a plan view of the cylindrical body of FIG. 5.

The other end 11 of the lever 9, which is positioned in the cavity 12 of the hollow cylindrical body 1, is formed with two parallel prongs 11*a,* as can best be appreciated from FIG. 8.

The end 11 with its prongs 11*a* is in contact with the outer surface 13 of a cup-shaped pumping member 14 the cavity of which faces towards the end 1*b* of the cylindrical body 1, defining a cavity or pumping chamber 15.

Figure 9:
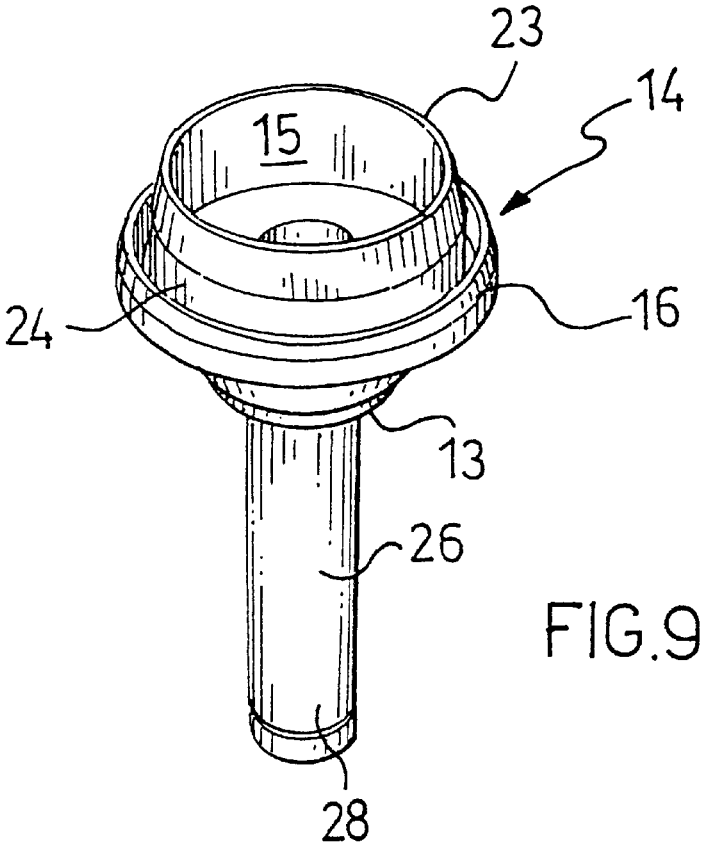
FIG. 9 is a perspective view of the pumping member with its tubular elements.

As can best be seen in detail in FIG. 9, the pumping member 14 is constituted by a resiliently flexible diaphragm and has, on its outer surface, a flange 16 which engages in an annular groove 17 of the body 1, in which it is firmly anchored by underlying ledges 18 integral with the body 1.

At the end 1*b,* the body 1 forms a cylindrical chamber 19 around which there is an annular channel 20. This channel is in communication with the duct 22 of the delivery element 7 by means of the annual channel orifice 21, as well as with the cavity 15 of the pumping member 14.

An annular flexible lip 23 of the pumping member 14, projecting from the circular rim 24 thereof, is positioned in the annular channel 20.

The circular rim 24 bears on the wall 25 of the body 1 which defines not only the groove 17 in which the flange 16 engages but also the annular channel 20 the inner wall of which is indicated 25*a*. The axial extent of the annular flexible lip 23, which normally bears on the wall 25*a* when the chamber 15 is full of liquid, is such as not to obstruct the orifice 21 of the delivery duct 22 completely.

A tubular element 26, fixed to the diaphragm of the pumping member 14 in a position coaxial with the body 1 and with the cylindrical chamber 19 has, at one end, a portion 27 extending inside the cavity 15 of the pumping member and, at the other end, a portion 28 extending towards the container 5.

A conventional suction pipe 29 immersed in the liquid inside the container 5 is fitted on the portion 28.

The portion 27 of the tubular element 26 has a plate 30 disposed across the tubular element orifice 31 and connected to the rim thereof for a portion of its circumference, about which portion the plate 30 can thus move angularly and perform the function of closing and opening the orifice.

The plate 30 has a small radial projection 32 which is intended to engage with the internal wall 19*a* of the chamber 19 during the operation of the pump.

The diameter of the cylindrical chamber 19 is in fact substantially equal to and, in any case, no smaller than the diameter of the portion 27 of the tubular element 26.

The axial extent of the chamber 19 is no less than the axial length of the portion 27 which therefore behaves as a piston relative to the chamber.

The means for engaging the cylindrical body 1 on the neck 4 of the container 5 is constituted, as already mentioned above, by a screw-threaded ring 3.

Figure 10:
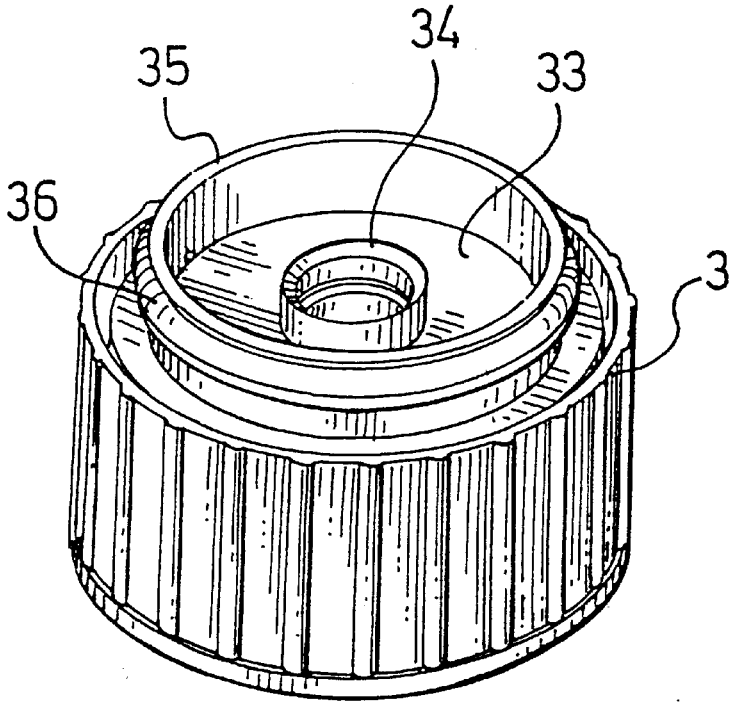
FIG. 10 is a perspective view of the means for engaging the pump on the container of liquid to be dispensed.

As can be appreciated from FIG. 10, the ring 3 has a diaphragm 33 with an axial hole 34 through which the portion 28 of the tubular element 26 which is fixed to the pumping member 14 extends and is engaged for sliding.

The ring 3 has a collar 35 around which there is an annular projection 36; this projection engages with the steps 37 provided inside the hollow cylindrical body 1.

The cylindrical body, together with the pump, is fixed firmly and removably to the container 5 by screwing the ring 3 onto the neck 4 of the container and the engagement of the projection 36 with the steps 37.

The pump operates in the following manner.

Figure 2:
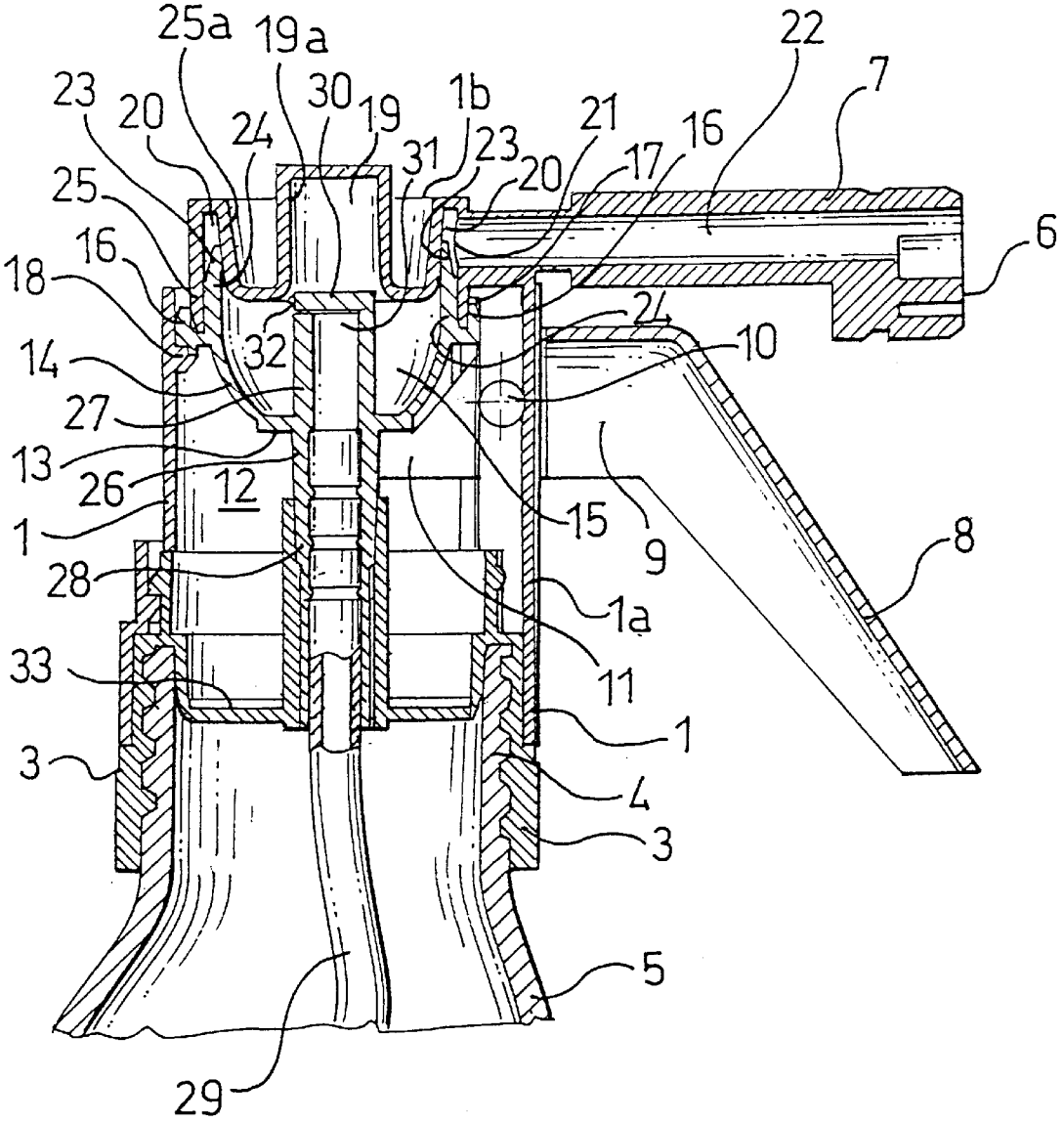
FIG. 2 is a vertical section through the body of the pump fixed to the container of liquid to be dispensed, with the pumping members in the rest position.

The pumping member 14 is considered to be in the position shown in FIG. 2, and the chamber 15 may be considered to be full of liquid to be dispensed.

If the trigger 8 is squeezed, the prongs 11*a*, between which the tubular element 26 is disposed, compress the diaphragm of the pumping member 14 pressurizing the liquid which is in the chamber 15 and at the same time also in the cylindrical chamber 19.

The rise in pressure causes the plate 30 to fit tightly against the orifice 31 of the tubular element 27 and thus close it; at the same time, the pressure causes the lip 23 to open out radially and to move away from the wall 25*a* of the channel 20 so as to allow the liquid to flow towards the orifice 21 and to be dispensed through the duct 22.

Figure 3:
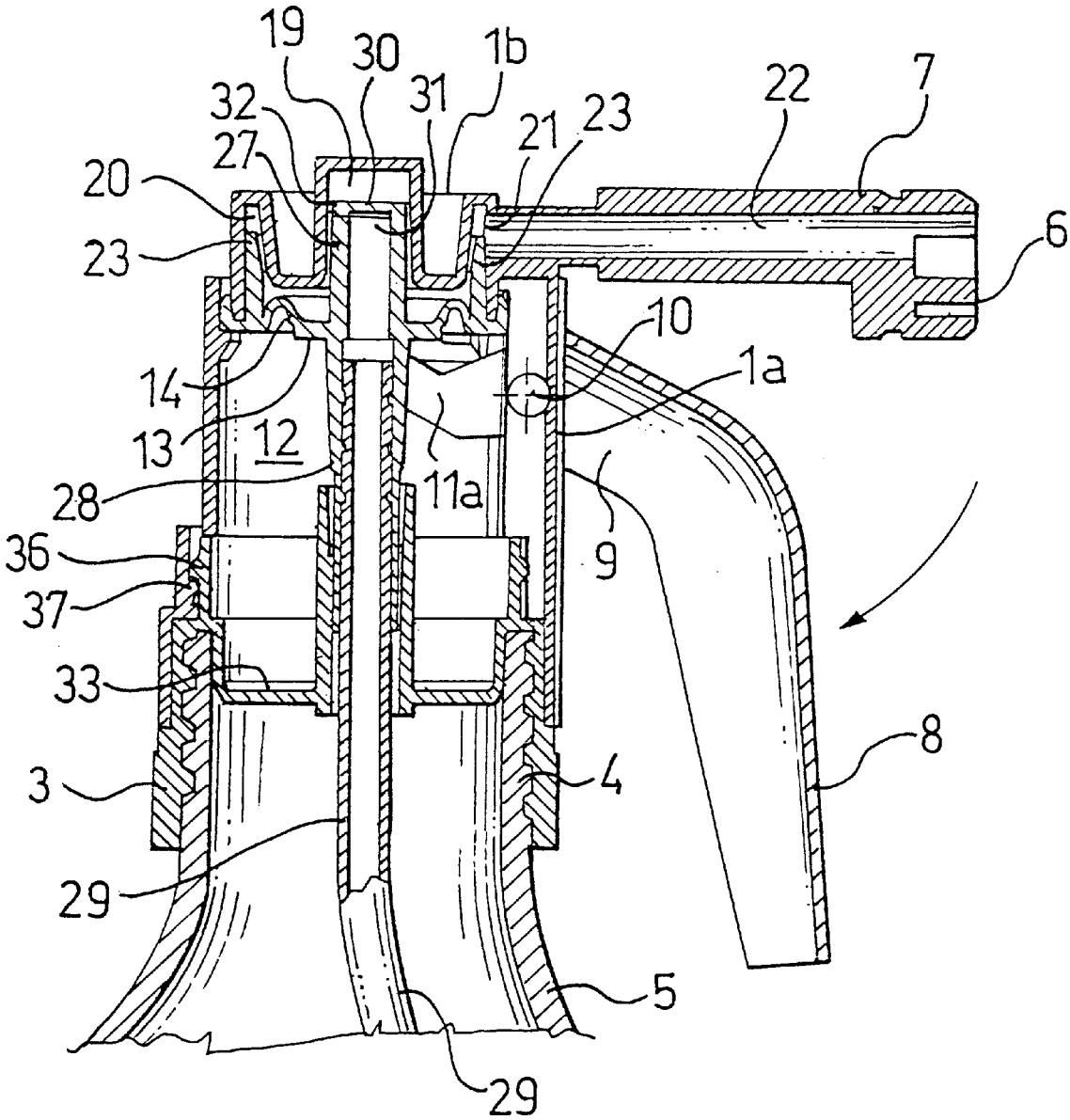
FIG. 3 is a sectioned view similar to that of FIG. 2 with the pumping members at the end of their travel upon completion of the dispensing of a dose of liquid.

The position and the shape adopted by the cup-shaped pumping member 14 upon completion of the dispensing of a dose of liquid is that shown in FIG. 3.

Upon release of the trigger 8, the resilience of the diaphragm of the member 14 causes expansion of the chamber 15 and produces a vacuum which returns the lip 23 to fit tightly against the wall 25*a* of the channel 20.

At the same time, the plate 30 is raised, opening the orifice 31 and consequently drawing liquid from the container 5 through the pipe 29, the tubular element 27 and the tubular element 28.

Lifting of the plate 30 from the rim of the orifice 31 is facilitated by the projection 32 which is engaged with friction on the surface 19*a* of the cylindrical chamber 19 in which the tubular element 27 slides like a piston.

Figure 4:
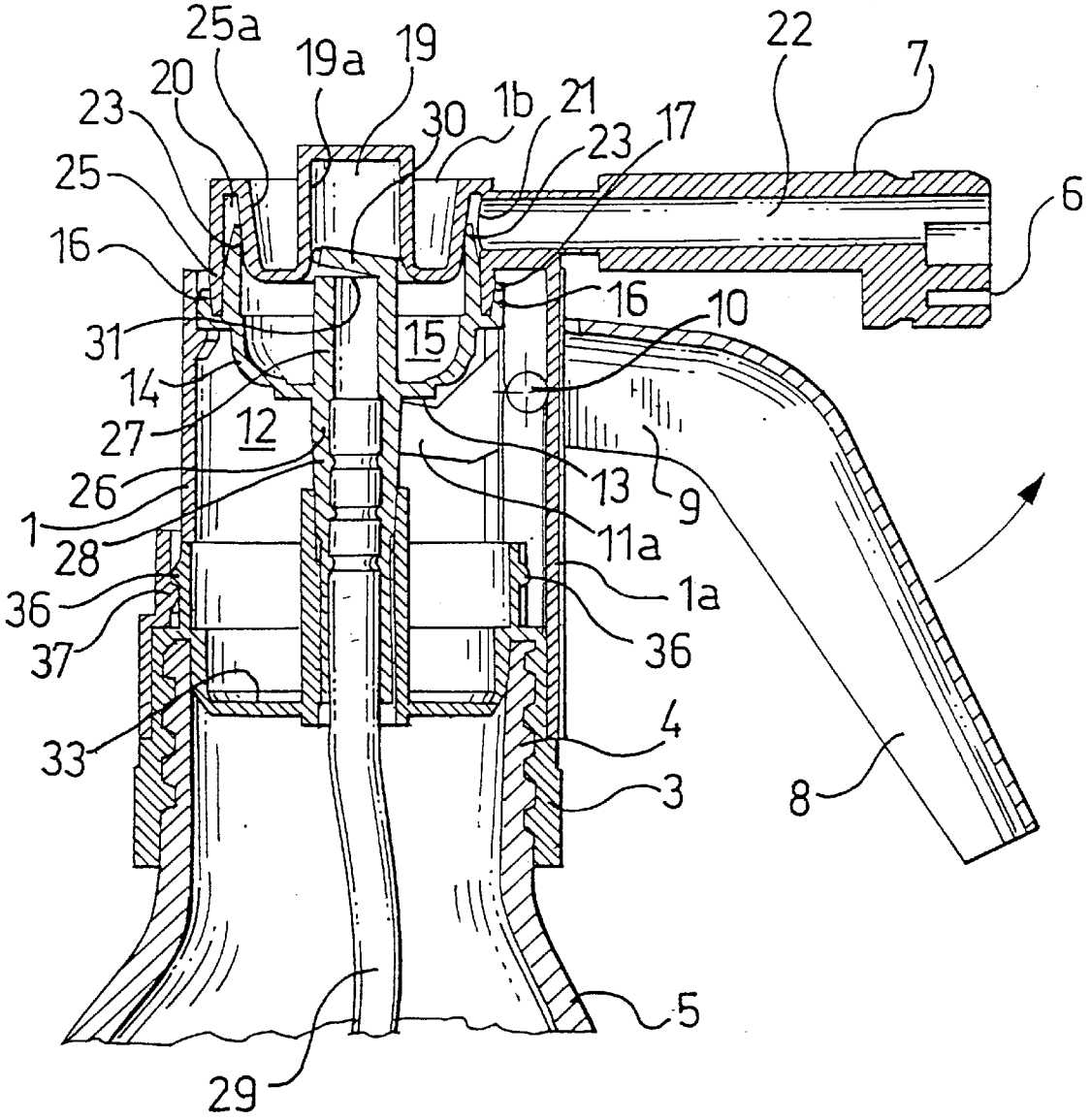
FIG. 4 is a sectioned view similar to those of FIGS. 2 and 3 with the pumping members in an intermediate stage of the drawing of the liquid from the container.
Figure 5:
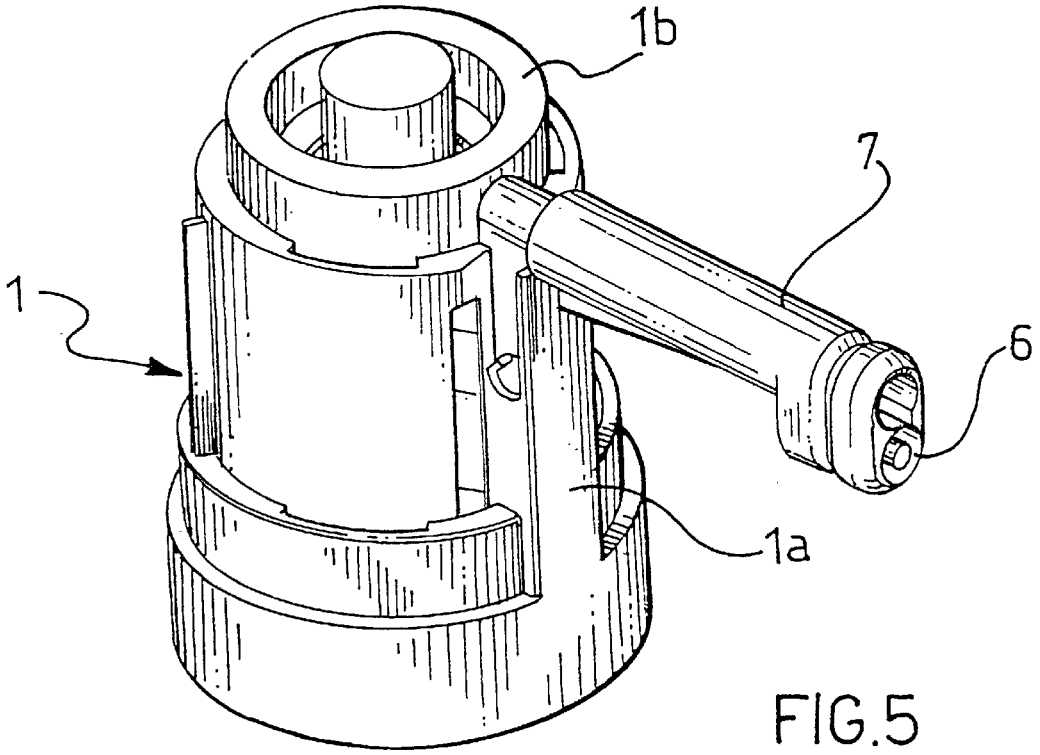
FIG. 5 is a perspective view showing the hollow cylindrical body of the pump alone.

Upon completion of the suction stroke, approximately as shown in FIG. 4, the chamber 15 is refilled with liquid ready to be dispensed in the manner described above.

It can be appreciated from the foregoing that the valve members of the pump according to the invention are not subject to twisting movements which could compromise their functional capacity over time, and that the pumping member with its valve members can be molded as a unitary component, as can the hollow cylindrical body, thereby dramatically reducing the number of components, benefiting the cost of the device.

I claim:

1. A pump for dispensing liquids comprising:

a pumping member having a diaphragm defining a fluid cavity, the pumping member communicating with a delivery duct via an annular channel orifice;

a tubular member having a first end disposed inside the fluid cavity and a second end that is engageable with a conduit for drawing fluid; and a lever that is mountable for pivoting about a pin, the lever including an engaging section that is selectively engageable with the pumping member for collapsing the pumping member diaphragm in an axial direction, wherein the tubular member guides axial movement of the pumping member.

2. A pump for dispensing liquids according to claim 1, further comprising a top member secured to the pumping member delimiting the fluid cavity and defining a chamber that is sized to receive the first end of the tubular member.

3. A pump for dispensing liquids according to claim 2, further comprising a tubular element orifice at the first end of the tubular element, wherein the tubular element orifice is closed by movement of the tubular element into the chamber, and wherein the tubular element orifice is opened by movement of the tubular element out of the chamber.

4. A pump for dispensing liquids according to claim 3, wherein the first end of the tubular element comprises a radial projection disposed adjacent the tubular element orifice, the radial projection engaging an interior surface of the chamber when the tubular element is disposed inside the chamber.

5. A pump for dispensing liquids comprising:

a hollow, cylindrical support body having an annular channel formed at a first axial end of the body and open towards an internal cavity of the body, a delivery duct carried by the hollow cylindrical body and projecting radially therefrom, the delivery duct being in communication with the annular channel by means of an annular channel orifice, engagement means disposed at the other end of the hollow cylindrical body for connection of the pump to a container of liquid to be dispensed, a pumping member comprising a diaphragm presenting a cavity facing the channel and a surface facing the means for connection to the container of liquid, and which is housed in the hollow cylindrical body, a flange fixed to the diaphragm of the pumping member, projecting radially outwardly relative to the cavity, and connected peripherally to an internal wall of the hollow cylindrical body in order to anchor the pumping member to the cylindrical body, a continuous flexible lip formed around the diaphragm periphery, the lip being positioned within the channel in order to close and open the annular channel orifice for access to the delivery duct, a lever mounted for pivoting about a pin carried by the hollow cylindrical body, said lever having a first end disposed inside the cavity of the hollow cylindrical body in contact with the surface of the diaphragm of the pumping member and a second end formed as a trigger disposed outside the hollow cylindrical body, for the manual operation of the pumping member in opposition to the resilient force due to deformation of the diaphragm of the pumping member, wherein the diaphragm of the pumping member is in the form of a resiliently-flexible cup-shaped diaphragm with a convex surface cooperating with the first end of the lever, and a tubular element extending through the cup-shaped diaphragm of the pumping member in a position coaxial with the hollow cylindrical body and being axially guided inside the cylindrical body between a non-deformed position of the pumping member and a deformed position of the pumping member, said tubular element having a first end provided with a tubular element orifice and extending inside the cavity of the cup-shaped diaphragm of the pumping member, and an opposite end, provided with an opposite tubular element end orifice, and extending towards the container of the liquid to be dispensed, the first end having a valve member for closing and opening the tubular element orifice, the opposite end being connected to a pipe extending into the container of the liquid to be dispensed in order to draw the liquid in.

6. A pump for dispensing liquids according to claim 5, wherein the tubular element extending through the cup-shaped flexible diaphragm of the pumping member is formed integrally with the diaphragm.

7. A pump for dispensing liquids according to claim 5, wherein the valve member carried by the end of the tubular element which is disposed inside the cavity of the diaphragm is constituted by a circular plate which is disposed across the tubular element orifice in order to close and open the tubular element and is connected to a rim of the orifice for a portion of its circumference, said plate being movable angularly about said portion of the circumference in order to close and open the tubular element orifice.

8. A pump for dispensing liquids according to claim 7, wherein the plate has at least one radial projection on its peripheral edge.

9. A pump for dispensing liquids according to claim 5, wherein the hollow cylindrical body has a cylindrical chamber positioned coaxially with the annular channel and with the tubular element, the cylindrical chamber having a diameter substantially equal to the outside diameter of the plate for closing and opening the tubular element orifice of said tubular element and an axial length no less than the length of the portion of the tubular element which extends within the cavity of the cup-like diaphragm of the pumping member.

10. A pump for dispensing liquids according to claim 5, wherein the opposite end of the tubular element extends through an internal sleeve-shaped aperture provided in the engagement means.

11. A pump for dispensing liquids according to claim 5, wherein the tubular element orifice of the tubular element first end is disposed at a level over the pumping member flange.

* * * * *

UNITED STATES PATENT AND TRADEMARK OFFICE

CERTIFICATE OF CORRECTION

PATENT NO. : 6,168,050 B1
DATED : January 2, 2001
INVENTOR(S) : Battegazzore

It is certified that error appears in the above-identified patent and that said Letters Patent is hereby corrected as shown below:

Title page,
Delete
"(30) Foreign Application Priority Data
May 21, 1998 (EP).....09930237.8"

and insert therefor

-- (30) Foreign Application Priority Data
April 21, 1998 (EP).....98830237.8 --

Signed and Sealed this

Second Day of October, 2001

*Attest:*

Nicholas P. Godici

*Attesting Officer*

NICHOLAS P. GODICI
*Acting Director of the United States Patent and Trademark Office*